United States Patent [19]

Schroeder et al.

[11] Patent Number: 4,613,129

[45] Date of Patent: Sep. 23, 1986

[54] EXERCISE BICYCLE ATTACHMENT

[76] Inventors: Charles H. Schroeder, 10408 E. 64th St., Raytown, Mo. 64133; Larry Farnham, 905 N. 39th, Blue Springs, Mo. 64015

[21] Appl. No.: 670,286

[22] Filed: Nov. 9, 1984

[51] Int. Cl.[4] ..... A63B 69/16

[52] U.S. Cl. ..... 272/73; 272/129; 272/132; 310/75 C

[58] Field of Search ..... 272/73, 131, 129, 132; 280/289; 310/75 B, 75 C

[56] References Cited

U.S. PATENT DOCUMENTS

| | | | |
|---|---|---|---|
| 574,167 | 12/1896 | Ray | 272/132 |
| 592,093 | 10/1897 | Law | 272/132 |
| 3,511,097 | 5/1970 | Corwin | 272/129 |

*Primary Examiner*—Leo P. Picard

*Attorney, Agent, or Firm*—Kokjer, Kircher, Bradley, Wharton, Bowman & Johnson

[57] ABSTRACT

An attachment which converts a stationary exercise bicycle into an electronic exercise machine. A base tube of the bicycle frame can be strapped to a floor plate to which an alternator is hinged. The alternator can be raised about the hinge axis so that a drive wheel on the alternator drive shaft is applied to the driven bicycle wheel. The alternator is maintained in its operating position by a rope and cooperating springs. By electrically controlling the field coil of the alternator, the load applied to the bicycle wheel can be varied. Electronic features include programmed exercise routines and visual displays of time, load, speed and pulse rate.

15 Claims, 5 Drawing Figures

10
12
14
16
18
20
24
30
32
34
36
38
40
42
44
46
48
50
52
53
56
58
60
62
64
66
76
78
90
98
116
122
124
132
134
136
138
140
142
144
146
F
4.
4.

EXERCISE BICYCLE ATTACHMENT

BACKGROUND OF THE INVENTION

This invention relates generally to exercise equipment and deals more particularly with an attachment which converts an ordinary stationary exercise bicycle into an electronic exercise machine.

Conventional exercise bicycles employ mechanical arrangements of various types to vary the load or resistance which the rider must overcome to pedal the bicycle. Typically, pedaling of the bicycle rotates a fly wheel equipped with a mechanical braking mechanism that offers resistance to the fly wheel rotation. The most common type of brake includes a small wheel which is brought into contact with the fly wheel with varying amounts of pressure. The rider encounters increased resistance when the pressure is increased. Caliper type brakes are also used and include either felt or rubber brake pads for applying the braking force to the wheel. Another type of brake that has been employed in exercise bicycles includes a flat belt which is drawn around the wheel and can be tightened to apply the braking force. The progressive tightening of the belt applies increasing resistance to turning of the wheel.

In all of these mechanical brakes, friction is relied upon to provide the braking action, and the components are subjected to heat and wear resulting from the frictional forces. Another problem is that the measurement of the resistance is either not possible or is inaccurate at best. Consequently, the resistance is normally adjusted by "feel" which can vary considerably depending upon the personal mood of the rider and other factors. The result is that a well planned exercise program involving the systematic use of known loads cannot be carried out on the conventional exercise bicycle.

In recent years, specialized exercise bicycles which incorporate modern electronics have been developed. These electronic systems can apply virtually any desired load and can accurately control and monitor the resistance which must be overcome. In addition, the load can be varied in a programmed manner in order to simulate riding the bicycle up and down hills, for example. The speed, the work that is being done, the pulse rate, the elapsed time of the exercise routine, and other information can be accurately determined and displayed to the rider so that he can continuously monitor his progress through the exercise routine. The primary drawback with electronic exercise machines of this type is that they require a specialized bicycle which makes the cost of the machine excessive.

SUMMARY OF THE INVENTION

The present invention provides a novel arrangement which economically converts a stationary exercise bicycle into an electronic bicycle which can be accurately controlled and programmed electronically. The main advantage is that full use can be made of the ordinary exercise bicycle while at the same time making available the benefits of modern electronics. In accordance with the invention, varying loads are provided by an alternator which can be accurately controlled as to the resistance offered to pedaling of the bicycle. The alternator is applied in a unique way to the exercise bicycle. A floor plate receives and is strapped to the base tube of the bicycle frame. The alternator is hinged to the floor plate and can be raised about the hinge connection to an operating position in which the bicycle wheel is contacted by a drive wheel for driving the alternator. A spring loaded rope and bracket arrangement holds the alternator against the bicycle wheel and is adjustable so that wheels having various sizes can be readily accommodated. When not in use, the alternator can be released from the bicycle wheel to avoid creating a flat or otherwise distorted area on the wheel.

The load encountered by the rider can be varied as desired by changing the electromagnetic field of the alternator, and this can be done accurately through a wide range and with an infinite number of settings. At the same time, the alternator output signal provides an indication of the speed of the bicycle and the amount of energy that is being expended. This information, together with other data such as pulse rate and time remaining or elapsed in the exercise routine, is visually displayed to the rider by conventional display circuitry. The alternator is controlled by a microprocessor which can be programmed to vary the resistance in any desired manner. Thus, various types of special exercise routines can be set up and a customized exercise program can be adopted for each individual based on his physical condition and/or other factors.

DETAILED DESCRIPTION OF THE INVENTION

In the accompanying drawings which form a part of the specification and are to be read in conjunction therewith and in which like reference numerals are used to indicate like parts in the various views.

Figure 1:
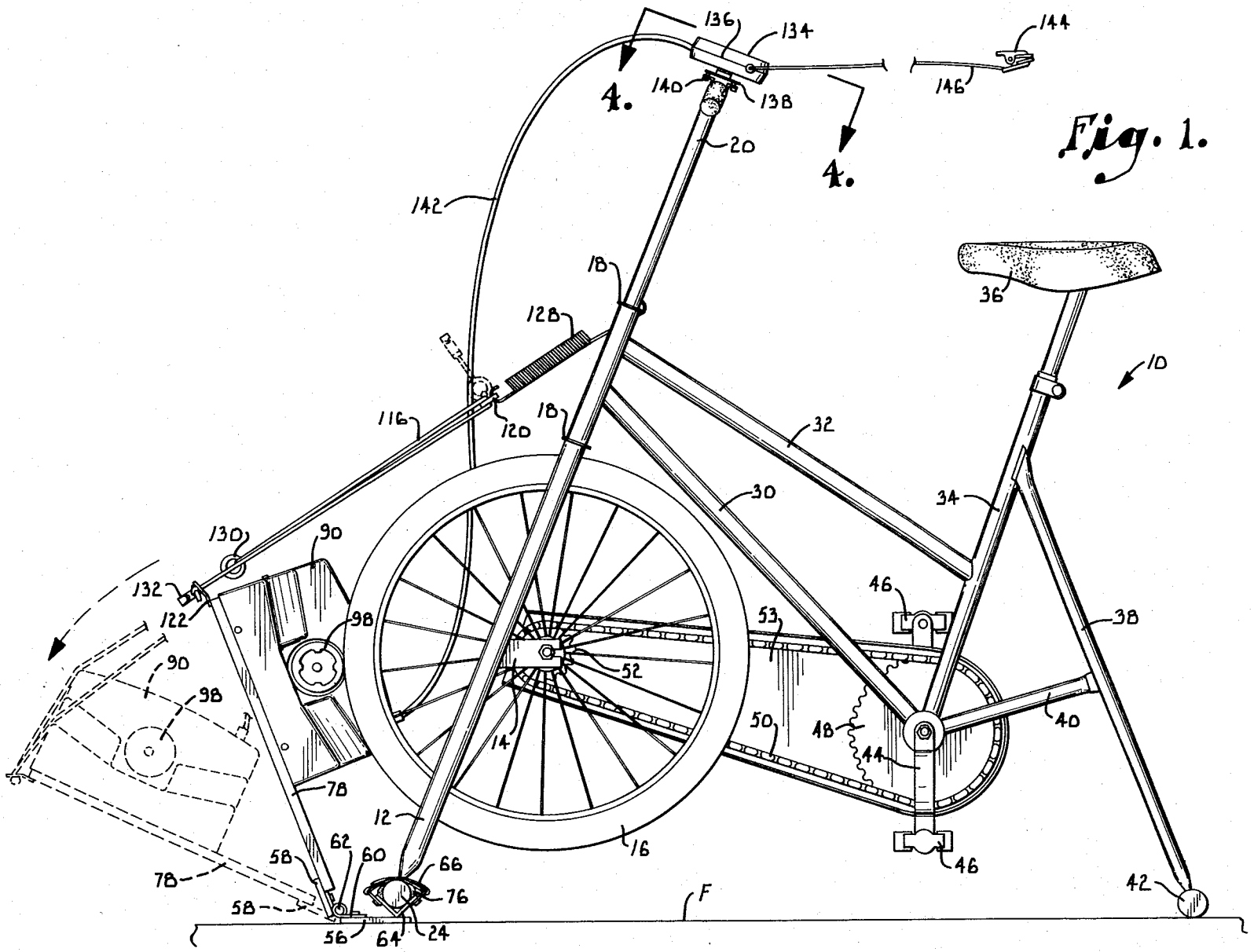
FIG. 1 is a side elevational view of a stationary exercise bicycle equipped with an attachment constructed according to a preferred embodiment of the present invention, with the broken lines showing the alternator released from the bicycle wheel.
Figure 3:
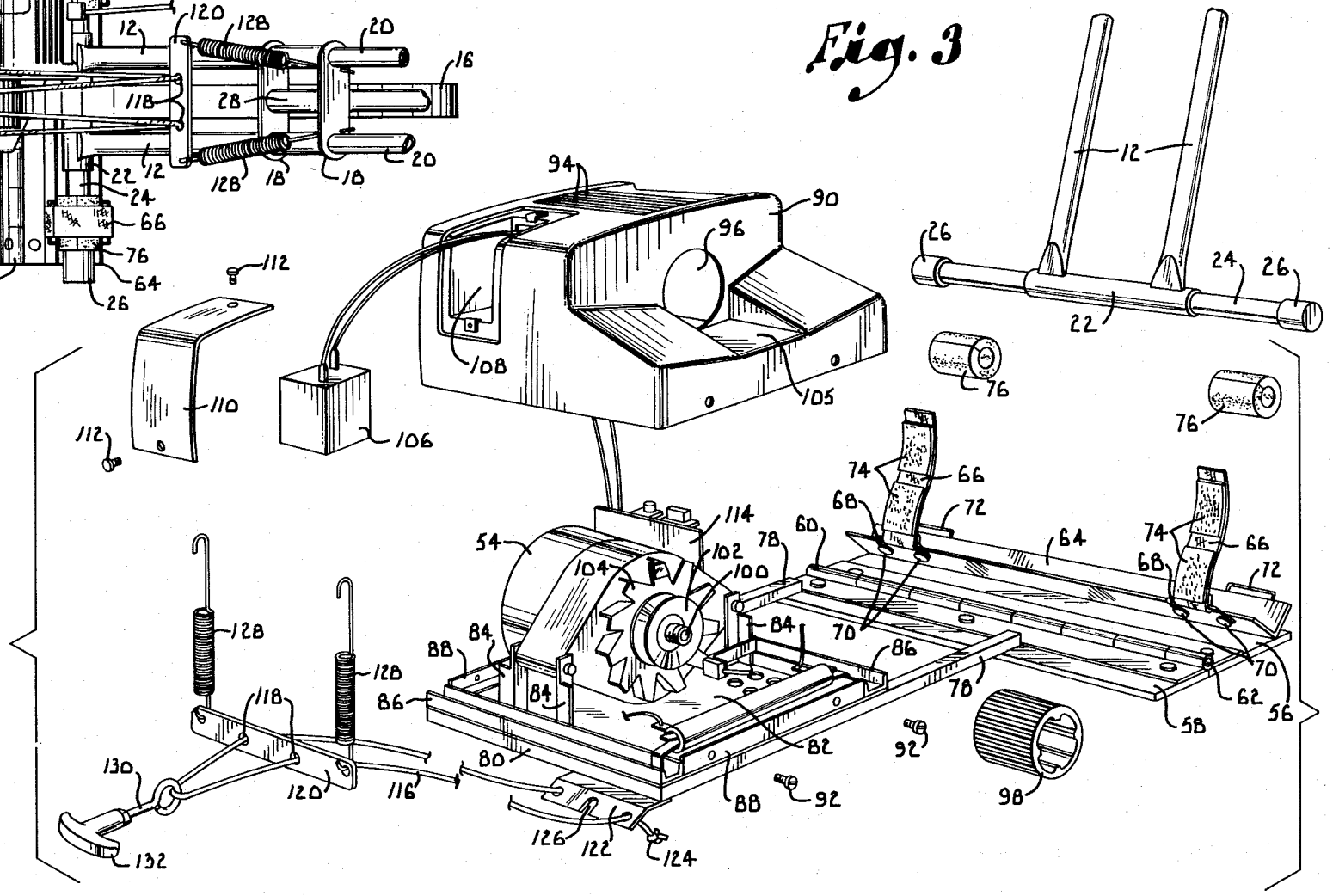
FIG. 3 is an exploded perspective view of the bicycle attachment of the present invention.

Referring now to the drawings in more detail and initially to FIG. 1, numeral 10 generally designates a conventional stationary exercise bicycle. The bicycle 10 has a rigid frame formed by a plurality of interconnected tubes. The frame includes a pair of parallel front legs 12 having brackets 14 between which a front wheel 16 of the bicycle is mounted for rotation. Near their top ends, the legs 12 are connected with one another by a pair of brackets 18. Extending from the upper bracket 18 are a pair of handle bars 20 which may be equipped with suitable hand grips. At the lower ends, the legs 16 connect with a horizontal sleeve 22 through which a base tube 24 extends, as best shown in FIG. 3. The base tube 24 is fixed to sleeve 22 and carries rubber pads 26 on its opposite ends.

Figure 2:
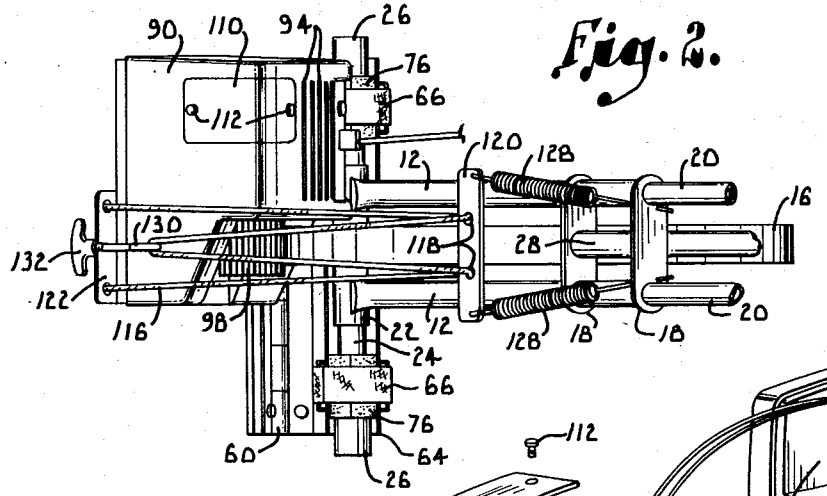
FIG. 2 is a fragmentary top plan view of the front portion of the bicycle and the attachment.

Extending between brackets 18 at a location between the legs 12 is a short tube 28 (FIG. 2) to which a pair of frame members 30 and 32 connect. The back ends of the frame members 30 and 32 connect with another tube 34 which receives an adjustable seat 36. The bicycle frame also includes a pair of back legs 38 connected with tube 34 and with additional frame members 40. The bottom ends of the back legs 38 connect with a base tube 42 which normally cooperates with the front base tube 24 to support the bicycle in a stationary position on a floor F or another supporting surface.

A crank 44 carries pedals 46 on its opposite ends and is supported for rotation on the bicycle frame. The crank drives a large sprocket 48 which receives a drive chain 50. The chain 50 is also drawn around a smaller sprocket 52 carried on the front wheel 16 so that the front wheel is turned when the bicycle is pedaled. A chain guard 53 covers the drive chain 50.

The present invention provides for the conversion of the conventional stationary exercise bicycle 10 into an electronic exercise machine which can be controlled and monitored electronically. In accordance with the invention, an alternator 54 (see FIG. 3) is driven by the front wheel 16 of the bicycle. The alternator 54 can be applied to and released from the wheel 16 by a unique arrangement which is best shown in FIG. 3.

The front base tube 24 of the bicycle frame can be secured to a floor plate 56 which is connected edge to edge with an adjacent plate 58 by a hinge 60. The hinge 60 includes a horizontal hinge pin 62 about which plate 58 can be pivoted relative to the floor plate 56. The floor plate is a flat metal plate to which a metal angle member 64 is welded or otherwise secured. The angle provides an open topped, V-shaped trough which closely receives the base tube 24, as best shown in FIG. 1.

A pair of flexible straps 66 can be tightened on the base tube 24 to secure it to the angle 64. Each strap 66 has one end secured to a metal bail 68 secured to one flange of angle 64 by rivets 70. The other flange of the angle is similarly provided with a pair of bails 72 through which the straps 66 may be passed. Each strap 66 has a pair of fasteners in the form of patches 74 provided with mating hook and loop fasteners on their exposed faces. After the base tube 24 has been inserted into the trough provided by the angle member 64, the straps 66 can be extended over the top of the base tube and passed through the bails 72. The straps can then be tightened and looped back on themselves, and the mating fasteners 74 can be applied to one another to secure the straps tightly against the base tube 24.

Preferably, a pair of split foam sleeves 76 are used to resist axial slipping of the base tube 24. The sleeves 76 may be slipped onto the opposite end portions of the base tubes 74 on opposite sides of the metal sleeve 22. The compressible foam sleeves 76 are aligned with the straps 66, so that the straps are actually tightened against the sleeves 76. This compresses the sleeves against the base tube 24 and assists in preventing the base tube from shifting axially in the angle member 64. The weight of the exercise bicycle also assists in retaining the base tube in place in the angle member.

The alternator 54 is carried on a framework which is rigidly connected with the hinged plate 58. The framework includes a pair of parallel arms 78 each in the form of a square tube and each secured at one end to plate 58, as by welding. Another square tube 80 extends between the opposite ends of arms 78. A flat plate 82 is secured on top of the square tubes 78 and 80, and the alternator 54 is mounted on upright posts 84 which extend upwardly from plate 82. A pair of channels 86 are secured to extend along opposite edges of plate 82. The opposite side edges of plate 92 are provided with angle members 88 which are secured to extend between the channels 86.

The alternator 54 is enclosed within a rigid plastic housing 90. The housing 90 is secured in position covering the alternator by screws 92 extended through the alternator housing and threaded into the channels 88. The top of the housing 90 is provided with ventilation slots 94. Plate 82 is likewise apertured for ventilation purposes. A round opening 96 is formed in one side of the housing 90 to permit a drive wheel 98 to extend out of the housing. The drive wheel 98 is a cylindrical member having a grooved periphery for contact with the circumference of the front bicycle wheel 16. The drive wheel 98 is threaded onto or otherwise secured to a drive shaft 100 which drives the alternator. The drive shaft also carries a pulley 102 and a fan 104. When the unit is assembled, the drive wheel 98 projects out of the housing through opening 96 so that it can be applied to the bicycle wheel. Underlying drive wheel 98 is a ledge surface 105 formed on housing 90.

A battery 106 which powers the electronic circuitry of the unit is mounted in a rectangular cavity 108 formed in the alternator housing 90. An L-shaped cover 110 normally encloses the battery 106 within cavity 108. Screws 112 are used to secure the cover 110 in place. A circuit board 114 is also mounted within the alternator housing 90. The printed circuit board is located to one side of the alternator 54 and contains the various electronic components of the unit.

The alternator 54 and related components can be raised and lowered by means of a spring loaded rope and bracket arrangement. A flexible rope 116 is passed loosely through a pair of holes 118 formed in a bracket bar 20. The opposite ends of the rope 116 are secured to a bracket plate 122 which extends forwardly from the square tube 80 of the alternator mounting framework. The opposite ends of the rope are passed through openings formed in plate 122 and are knotted at 124 to prevent the ends of the rope from passing back through the plate openings. Plate 122 has a notch 126 formed in its forward edge.

A pair of tension springs 128 connect bar 120 with the bicycle frame. The lower ends of springs 128 are hooked to the opposite ends of bar 120. Each spring 128 is hooked at its upper end to the upper bracket 18 which forms part of the bicycle frame. The center portion of the rope 116 extends through an eye bolt 130 to which a handle 132 is connected. The shank of the eye bolt 130 can be engaged in the notch 126 of plate 122, as will be more fully explained.

Figure 4:
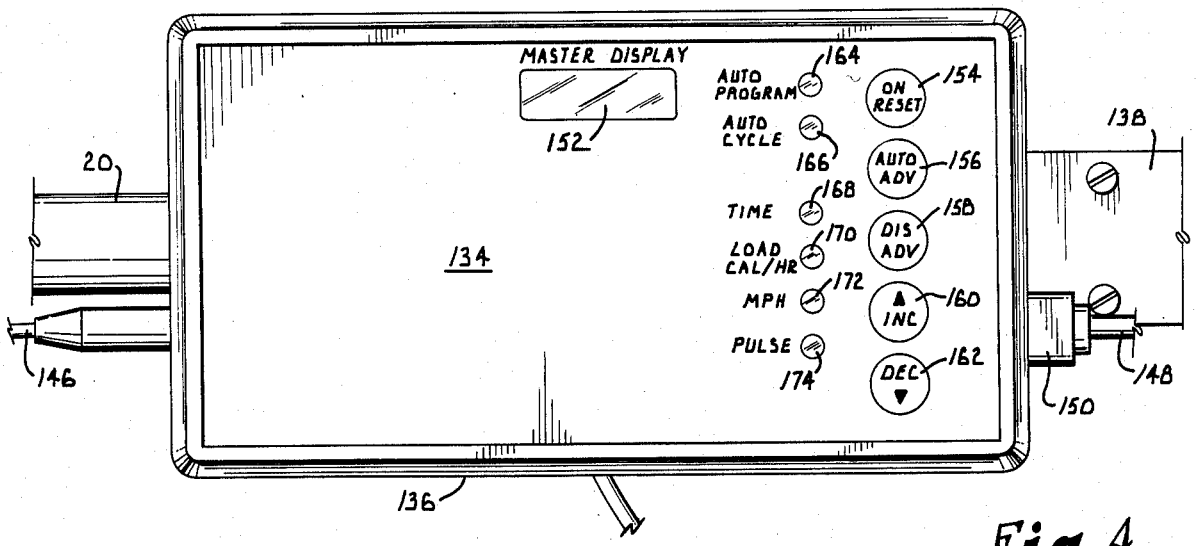
FIG. 4 is a top plan view on an enlarged scale taken generally along line 4—4 of FIG. 1 in the direction of the arrows and showing the control and display panel for the attachments.

As best shown in FIGS. 1 and 4, a control panel 134 is located on the face of a box 136. The box 136 is mounted on a bracket 138 which is secured by a U-shaped clamp 140 to one of the handle bars 20 of the bicycle. In this manner, the box 136 is mounted at a location where panel 134 is readily visible and accessible for operation of its switches. A cable 142 electrically connects the box 136 with the printed circuit board 114 located within the alternator housing 90. An ear clip 144 serves as a pulse monitor which may be clipped onto the ear of the bicycle rider to monitor the pulse rate. The pulse rate monitor clip 144 is connected with box 136 by an insulated conductor 146. As shown in FIG. 4, a cable 148 carrying a plug 150 may be plugged into the side of the box 136 for electrical connection of the electronic circuitry with a video monitor, a computer, or other equipment of a similar nature.

The control panel 134 has a master display screen 152 which provides a digital display, preferably a seven segment display. Also located on the panel 134 are five switches, including an On/Reset switch 154, an automatic advance switch 156, a display advance switch 158, an increase switch 160 and a decrease switch 162. Located in a row to one side of the array of switches are a plurality of LED indicators arranged in a row. These include an automatic program indicator 164, an automatic cycle indicator 166, a time indicator 168, a load (calories per hour) indicator 170, a miles per hour indicator 172 and a pulse rate indicator 174.

Figure 5:
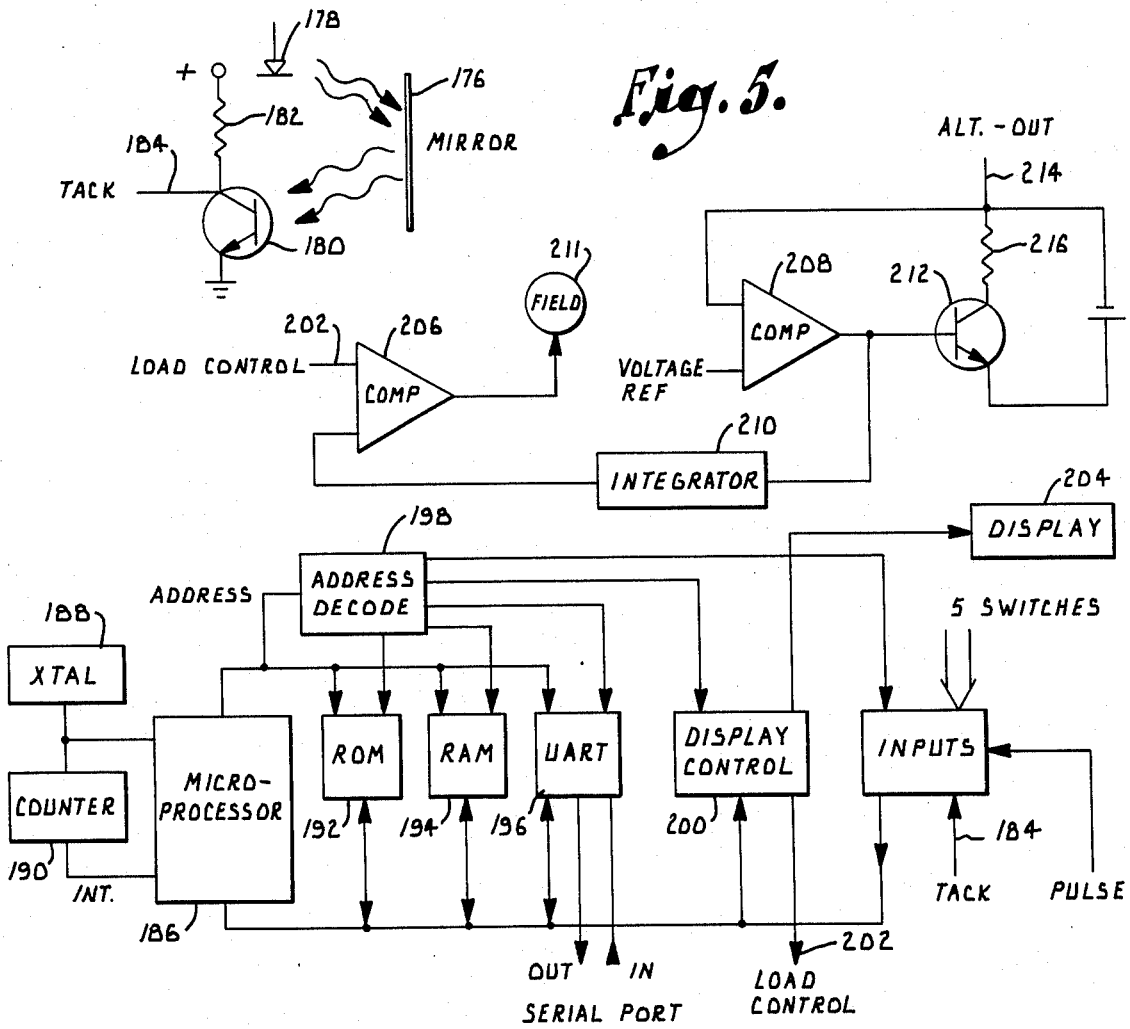
FIG. 5 is a block diagram of the electronic control system of the attachment.

The electronic circuitry included in the unit is illustrated in block diagram form in FIG. 5. A reflective type tachometer includes a mirror 176 which may be carried on the drive shaft 100 of the alternator 154. Each time the drive shaft makes one revolution, the mirror receives light from a light emitting diode 178 and reflects the light onto a photo sensitive transistor 180. A positive voltage is applied to the collector of the transistor 180 through a resistive load 182. The emitter of the transistor is connected with ground. The transistor becomes conductive each time the alternator drive shaft makes one revolution, and the rate at which pulses are applied to a tachometer line 184 thus provides an indication of the speed of revolution of the bicycle wheel.

As microprocessor 186 controls the load applied to the exercise bicycle and other aspects of the system operation. A crystal 188 is connected with the microprocessor and with a counter 190 which connects with the interrupt line of the microprocessor. The microprocessor connects with a read only memory 192, a random access memory 194 and a universal asynchronous receiver-transmitter chip 196 which permits data to be transferred to and from the microprocessor circuitry. Address information is applied to an address decoder 198 connected with a display control circuit 200. Under microprocessor control, the display control circuitry 200 provides a load control signal on line 202. The display control circuit 200 also drives a display circuit 204 which provides the visual display on panel 134.

The inputs to the unit are applied to the microprocessor and include inputs from the five switches 154–162 on the display panel 134. Additional inputs are a pulse rate input provided by the pulse rate sensor 144 and a tachometer input on line 184.

The load control signal on line 202 is applied as one input to a power comparator 206. The other input to comparator 206 is the output signal from power control comparator 208 after processing by integrating circuitry 210. The output signal from comparator 206 is applied to the field coil 211 of the alternator 54. The output signal from comparator 208 is applied to the base of a transistor which is turned on and off to maintain a constant voltage out of the alternator. One input to comparator 208 is a voltage reference. The second input to comparator 208 connects with an alternator output line 214. The alternator output line also connects with the collector of transmitter 212 through a one omh resistor 216. The duty cycle seen out of comparator 208 is integrated by circuit 210 and compared to the load control in comparator 206. The field voltage is controlled by comparator 206 which determines the power out of the alternator which causes the duty cycle out of comparator 208 to correspond to the load control.

In use of the arrangement of the present invention, the front base tube 24 of the exercise bicycle is strapped into the angle member 64 in the manner indicated. The alternator 54 can be raised and lowered about the horizontal hinge axis provided by pin 62 between the operating position shown in solid lines in FIG. 1 and a release or standby position wherein the alternator mounting assembly rests on the floor F. When the exercise bicycle is to be used, the alternator is raised to its operating position. This can be accomplished by pulling upwardly on the handle 132 of rope 116 until the drive wheel 98 for the alternator is in contact with the circumference of the front bicycle wheel 16. The shank of the eye bolt 130 can then be inserted into the notch 126, and the handle 132 is then held by plate 122 in the position shown in FIG. 2 and in solid lines in FIG. 1. This maintains the rope 116 in a taut condition, with the rope and the springs 128 cooperating to hold the drive wheel 98 against the bicycle wheel 16 in a resilient manner. The force of the springs 128 acts resiliently to maintain the drive wheel of the alternator against the bicycle wheel against the weight of the alternator assembly which tends to lower it.

The resilient manner in which the alternator drive wheel 98 is held against the front bicycle wheel 16 allows the unit to accommodate on "out of round" condition of the bicycle wheel and other imperfections. At the same time, the drive wheel is held firmly against the bicycle wheel so that the alternator drive wheel 98 is driven in response to turning of the bicycle wheel. It should be noted that the position of the knots 124 can be varied as desired so that bicycle wheels of different sizes can be easily accommodated.

When the exercise bicycle is not in use, the alternator assembly is preferably lowered to the standby position so that no force will be exerted against the bicycle wheel tending to create a flattened area or other deformation in the bicycle wheel. Lowering of the unit can be easily accomplished simply by grasping the handle 132 and removing the eye bolt 130 from notch 126. The unit can then be slowly lowered to the broken line position of FIG. 1 and eventually onto the floor in the standby position.

When the alternator is in its operating position, the current applied to the field coil 211 of the alternator controls the resistance that must be overcome to turn the bicycle pedals 46. The microprocessor 186 controls the field coil of the alternator and thereby provides an accurate variation in the load that must be ovecome by the rider of the bicycle.

The unit has various operating modes and display modes controlled by the switches on the display panel 134. Depression of the On/Reset switch 154 activates the unit. When the unit is switched on, the display is initially in the time mode, and the time indicator 168 is energized. Zero time is initially displayed on the master display 152. However, the clock does not operate at this time. The clock will begin to count when the bike is operated at a minimum speed of 1 MPH. The elapse time will be displayed and will continue to count as long as the bike is operated at a speed greater than 1 MPH. While in the time mode, a specific exercise time can be selected. Depress either the increase switch 160 or the decrease switch 162 and a 20 minute period will be displayed. The clock will now count down displaying the remaining time. The increase switch 160 can be depressed to increase the time, or the decrease switch 162 can be depressed to decrease the time. The time is incremented or decremented slowly for the first five counts and then more rapidly. By holding the finger on either the increment switch 160 or the decrement switch 162, any desired time period can be entered on the master display 152.

The unit can be placed in a count up mode to display the time that has elapsed during the exercise routine. The count up mode is accessed by depressing the display advance switch 158 and the increase switch 160 simultaneously. The clock then begins to count up from zero and the exercise routine can begin. The time that is displayed on the master display 152 indicates the time that has elapsed since the start of the exercise routine.

The unit can alternatively be placed in a count down mode in which it counts down toward zero from the time initially displayed on the master display screen 152. To place the unit in the count down mode, the display advance switch 158 and decrement switch 152 are depressed simultaneously. The clock then begins to count down toward zero from the initial time on the master display. This allows the display of the time remaining in the exercise routine rather than the elapsed time as is displayed in the count up mode.

In addition to the time position, the display also has a load display position in which the load indicator 170 is on and the load in calories per hour is displayed on the master display 152. As previously indicated, the load is controlled by the field coil of the alternator which is in turn controlled by the microprocessor. The load can be increased or decreased by depressing the increase switch 160 or the decrease switch 162 with the display in any position other than the time position, or if the unit is in the auto cycle mode of operation which will be subsequently described.

The other two display positions are the MPH position in which the MPH indicator 172 is energized and the speed of the bicycle is displayed (in miles per hour) on the master display, and the pulse rate position in which the pulse indicator 174 cycles on and off with each heart beat and the pulse rate of the rider is displayed on the master display 152. If the pulse rate monitor 144 is not in use, the pulse rate will be zero.

The auto cycle mode of operation is accessed by depressing the auto advance switch 156. Then, the auto cycle indicator 166 is energized, and the display cycles successively through the time mode, the load mode, the MPH mode, and the pulse mode, in that order. Each display position is accessed for two seconds, and the unit then automatically advances to the next display position. The LED indicators 168–174 are energized in succession in the auto cycle mode, and the master display successively displays the time (either elapsed or remaining), the load (in calories per hour), the bicycle speed (in miles per hour) and the pulse rate (in beats per minute). The unit will continue to cycle through the display until the auto advance switch 156 is depressed again, and the unit is then placed in the normal display mode. In the event that the pulse rate is zero, as when the pulse rate monitor is not being used, the pulse display is skipped in the auto cycle mode and the unit cycles successively through the other three display positions.

In the normal display mode of the unit, the display advance switch 58 can be used to advance the display to any position. For example, if the unit is in the time display position, one depression of switch 158 will advance it to the load display position, and successive depressions advance the unit to the MPH display position and the pulse rate position and then to the time display position again.

The unit also has an automatic program mode of operation in which one of a plurality of special automatic exercise routines can be carried out. For example, one of the automatic routines may simulate riding of the bicycle up and down hilly terrain, while others may simulate riding over flat terrain or alternating flat and hilly terrain. In any event, the various automatic exercise routines can be programmed into the unit and provided with corresponding program numbers.

The automatic program mode is accessed by depressing the auto advance switch 156 and the display advance switch 158 simultaneously. The first simultaneous depression of the switches places the unit in the auto program mode in which indicator 164 is energized. The first depression also accesses the first preprogrammed exercise routine, and subsequent simultaneous depressions of switches 156 and 158 accesses the successive programmed routines. The number corresponding to the accessed routine is displayed on the master display 152. When the display is advanced to the number corresponding to the desired automatic program, the display advance switch 158 is depressed to place the unit back in the normal display mode. The programmed exercise routine can then be carried out, and the time, load, MPH and pulse rate indications can be displayed in the normal manner as the routine progresses.

It is thus apparent that the present invention provides an economical unit which can be quickly and easily applied to an ordinary stationary exercise bicycle to convert it into an electronic exercise machine which permits controlled exercise routines to be carried out. The load is accurately controlled by the microprocessor and related electronics, so that there is no reliance on the "feel" of the rider. If the bicycle is one having feet at the bottoms of the legs 12 rather than the cross tube 14, a suitable adapter (not shown) can be applied to the bicycle to permit the alternator assembly to be applied to it in substantially the same manner previously described.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. An attachment for a stationary exercise bicycle having a frame for supporting the bicycle on the floor, a rotatable wheel and pedals for turning the wheel when the bicycle is pedaled, said attachment comprising:

a floor plate resting on the floor;

means for connecting the bicycle frame to said floor plate at a location adjacent the bicycle wheel;

an alternator having a drive shaft for driving of the alternator when turned;

a drive wheel mounted on said drive shaft;

hinge means for connecting said alternator with said floor plate in a manner permitting the alternator to be raised and lowered about a generally horizontal hinge axis between an operating position wherein said drive wheel is engaged against the bicycle wheel to be driven thereby and a release position wherein the alternator rests on the floor with the drive wheel released from the bicycle wheel; and releasable means for holding said alternator in the operating position, whereby the alternator can be adjusted to vary the load applied by said drive wheel to the bicycle wheel.

2. The invention of claim 1, wherein the bicycle frame includes a base member oriented generally parallel to the rotational axis of the bicycle wheel and said connecting means includes:

a trough member on said floor plate presenting an open topped trough for closely receiving the base member of the bicycle frame; and means for securing the base member in said trough.

3. The invention of claim 2, wherein said securing means includes flexible strap means on said trough member adapted to be tightened on the base member to hold same in the trough and releaseable means for maintaining said strap means in a tight condition against the base member.

4. The invention of claim 2, wherein said securing means includes:

a pair of flexible straps each having one end secured to the floor plate, said straps being spaced apart and being adapted to be tightened against opposite end portions of the base member when same is inserted into the trough; and releaseable means for maintaining said straps in a tight condition against said opposite end portions of the base member.

5. The invention of claim 4, including a pair of compressible sleeves applicable to the opposite end portions of the base member, said straps being tightened against the respective sleeves to compress same against the base member, thereby preventing the base member from slipping axially in the trough.

6. The invention of claim 1, including a substantially enclosed housing containing said alternator and presenting an opening through which said drive wheel extends.

7. The invention of claim 6, including a rigid framework on which said alternator and housing are mounted, said hinge means including a hinge connection between said framework and floor plate.

8. The invention of claim 1, wherein said releaseable means includes a resilient means for urging the alternator in a direction to hold said drive wheel against the bicycle wheel.

9. The invention of claim 1, wherein said releaseable means includes:

a bracket;

spring means for connecting said bracket resiliently with the bicycle frame;

fixedly an elongate flexible member secured to the alternator and loosely to said bracket to permit said flexible member to be pulled to a taut condition to lift said alternator to the operating position with said flexible member and spring means cooperating to resiliently maintain the alternator in the operating position; and means for maintaining said flexible member in said taut condition to hold the alternator in the operating position.

10. An arrangement for attaching an alternator of an electronic exercise system to a stationary exercise bicycle having a rotatable wheel and a frame with a base member, said arrangement comprising:

a generally flat floor plate having means for receiving the base member of the bicycle frame;

means for connecting the base member to said receiving means;

a drive wheel attached to the alternator to drive same;

a housing containing the alternator therein and having an opening through which said drive wheel extends out of the housing;

hinge means for connecting said housing with said floor plate for movement of the housing about a generally horizontal hinge axis toward and away from the bicycle wheel; and releaseable means for holding said housing in an operating position wherein said drive wheel is in contact with the bicycle wheel to be driven thereby, said alternator being adjustable to vary the resistance offered thereby to turning of the bicycle wheel, said releaseable means comprising a bracket, spring means for connecting said bracket resiliently with the bicycle frame, and an elongate flexible member connected with said housing and passing loosely through said bracket to effect raising of the housing to said operating position when said flexible member is pulled to and secured in a taut condition with said flexible member and spring means cooperating to hold the housing in the operating position.

11. The invention of claim 10, wherein said connecting means includes a pair of flexible straps adapted to be tightened on the base member of the bicycle frame.

12. The invention of claim 11, including a pair of compressible sleeves applicable to the base member at locations to have said straps tightened against said sleeves to compress same against the base member, thereby resisting axial slipping of the base member on said floor plate.

13. The invention of claim 10, wherein said receiving means comprises an open topped trough on said floor plate for closely receiving the base member.

14. An attachment for a stationary exercise bicycle having a frame with a base member and a rotable wheel, said attachment comprising:

a floor plate means for connecting the base member of the bicycle frame with said floor plate;

an alternator having a drive shaft to effect driving of the alternator upon turning of the drive shaft;

a drive wheel on said drive shaft;

hinge means for connecting said alternator with said floor plate for hinged movement about a generally horizontal hinge axis toward and away from the bicycle wheel between an operating position wherein said drive wheel is engaged against the bicycle wheel to be driven thereby and a release position wherein the drive wheel is displaced from the bicycle wheel and is not driven when the bicycle wheel is rotated; and resilient means for holding the alternator in said operating position thereof, said alternator being electrically controlled to vary the load applied to the bicycle wheel by said drive wheel in the operating position.

15. The invention of claim 14, wherein said resilient means comprises:

a bracket;

spring means for connecting said bracket resiliently with the bicycle frame;

an elongate flexible member secured fixedly to the alternator and loosely to said bracket to permit said flexible member to be pulled to a taut condition to lift said alternator to the operating position with said flexible member and spring means cooperating to resiliently maintain the alternator in the operating position, and means for maintaining said flexible member in said taut condition to hold the alternator in the operating position.

* * * * *